United States Patent [19]

Janssen et al.

[11] 4,313,328

[45] Feb. 2, 1982

[54] PROVIDING CARDAN AND UNIVERSAL JOINT-TYPE SHAFTS WITH GEARING

[75] Inventors: Manfred Janssen, Krefeld; Karl Austermann, Duesseldorf; Volker Schmidt, Muelheim, all of Fed. Rep. of Germany

[73] Assignee: Mannesmann Aktiengesellschaft, Düesseldorf, Fed. Rep. of Germany

[21] Appl. No.: 161,354

[22] Filed: Jun. 20, 1980

[30] Foreign Application Priority Data

Jun. 25, 1979 [DE] Fed. Rep. of Germany ..... 2925927

[51] Int. Cl.[3] ..... B21C 37/20

[52] U.S. Cl. ..... 72/276; 72/283; 72/370

[58] Field of Search ..... 72/209, 256, 276, 283, 72/370, 367, 358, 359

[56] References Cited

U.S. PATENT DOCUMENTS 2,258,242 10/1941 Ditzel et al. ..... 72/276

3,744,290 7/1973 Sirois ..... 72/283

*Primary Examiner*—Lowell A. Larson

*Attorney, Agent, or Firm*—Smyth, Pavitt, Siegemund & Martella

[57] ABSTRACT

A hollow, tubular blank is provided with annular, radially inwardly and/or outwardly extending protrusions by means of rolling or upsetting. These protrusions are provided with gearing teeth by means of an annular drawing die and a plug, one of these or both being provided with a gearing-forming profile.

2 Claims, 4 Drawing Figures

Fig.1
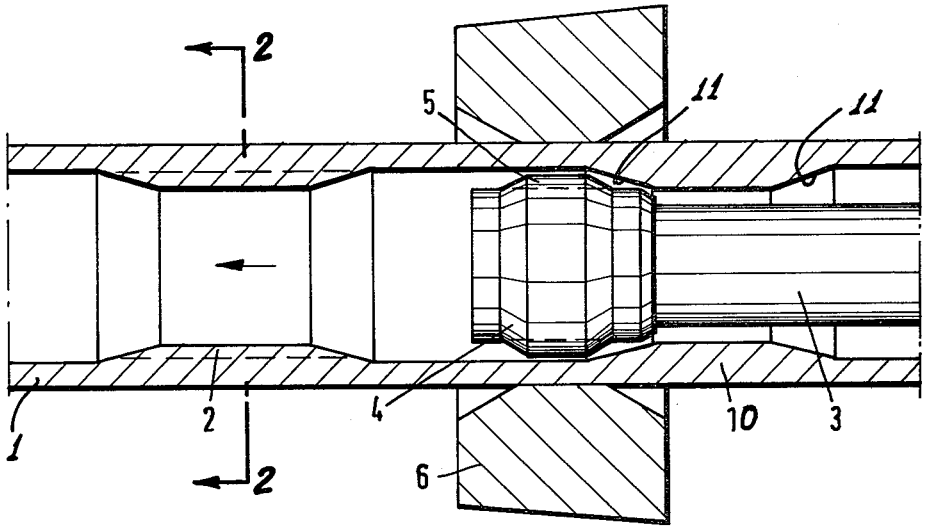
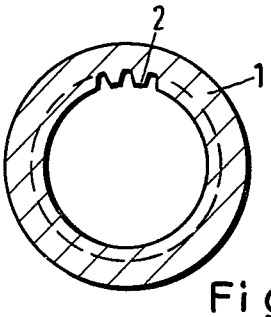
Fig.2
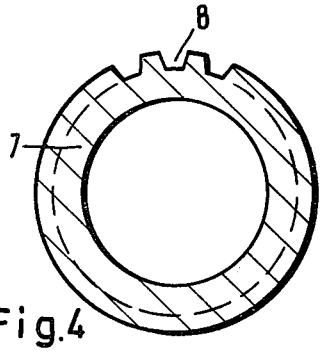
Fig.4
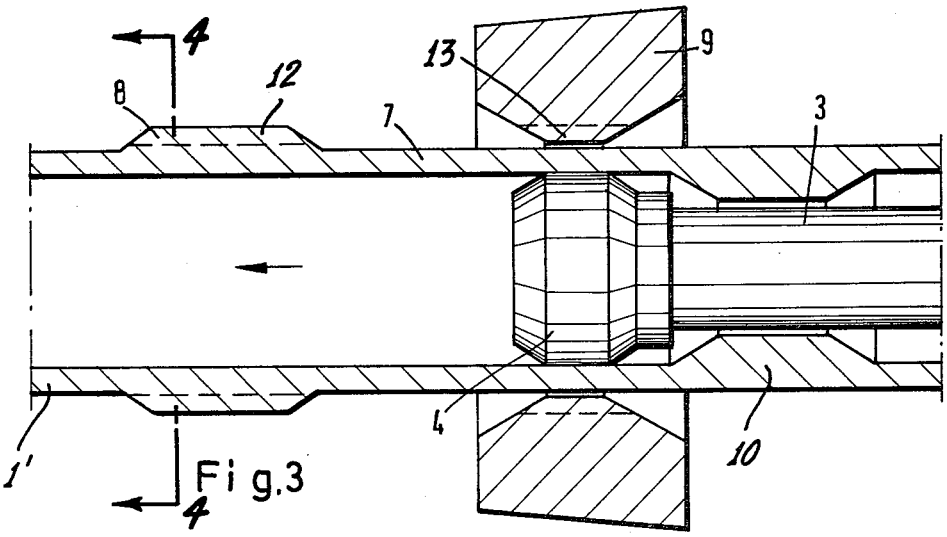
Fig.3

PROVIDING CARDAN AND UNIVERSAL JOINT-TYPE SHAFTS WITH GEARING

DESCRIPTION OF THE INVENTION

The present invention relates to the making of cardan shafts or universal joint shafts which include gearing.

Universal, joint-type shafts are in some cases provided with an end gearing. The shafts are solid and any profile contours such as gearings are mechanically worked into the shaft's material. Shafts of this type are necessarily quite heavy. Universal, joint-type shafts are known which include a tubular center piece; and a solid part carrying a gearing is welded to that center piece. This type of an arrangement is still quite heavy. Moreover, the welding gives rise to a potential source for defects.

DESCRIPTION OF THE INVENTION

It is an object of the present invention to provide cardan or universal, joint-type shafts with gearing under exclusive utilization of hollow, i.e., tubular, blanks.

In accordance with the preferred embodiment of the present invention, it is suggested to provide a tubular blank with annular, radially inwardly and/or outwardly extending protrusions by means of rolling, skew rolling, upsetting, or the like, and to provide these protrusions with gearing profiles by means of drawing under utilization of a drawing die and a plug being radially aligned with the die, whereby the die or the plug, or both, have a gear-forming profile.

It can, thus, be seen that the invention permits the exclusive use of hollow parts for cardan shafts, universal joint shafts, or the like, so that these shafts are lighter and the making of them is actually simplified.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

FIG. 1 shows a longitudinal section through a blank with inward protrusion that is being worked in accordance with the preferred embodiment of the invention for practicing the best mode thereof;

FIG. 2 shows a cross section as indicated by lines 2—2 in FIG. 1;

FIG. 3 shows a section view similar to FIG. 1, but providing possible modifications and supplementation of the process as explained in the reference to FIG. 1; and FIG. 4 shows a cross section as indicated by lines 4—4 in FIG. 3.

Proceeding now to the detailed description of the drawings, FIG. 1 illustrates a tube being worked to provide localized internal gearing. Prior to such working, a tubular blank 1 has been prepared by means of rolling, skew rolling, upsetting, or the like, possibly combined with external sizing in order to provide the tube with radially inwardly extending annular protrusions 10, preferably with bevelled transition portions 11 that lead to and from the adjoining tube portions having a uniform, internal diameter. The wall thickness of the tube in between protrusions is selected primarily on the basis of adequate strength requirements for the tube. Otherwise, the walls should be as thin as possible and practicable.

The particular process step illustrated in FIG. 1 is carried out under utilization of a drawing die 6 whose inner diameter matches the outer diameter of the tube. The die serves as an annular support for preventing outward bulging of the tube during drawing. This die cooperates with a plug or head 4, having a gearing-type profile 5 and being held on a rod 3 so that the plug or head 4 is radially aligned with the die 6.

As the tubular blank 1 is drawn in the direction of the arrow, the protrusions 10 are provided with internal gearing 2, such as is depicted more fully in FIG. 2.

FIG. 3 actually illustrates two cases. Firstly, the tubular blank is presumed to be provided with external, i.e., radially outwardly extending, annular protrusions 12. The die element, in this case die 9, is provided with a gearing profile and working portion 13 in order to provide gearing 8 on protrusion 12 as the tubular blank is drawn in the direction of the arrow. The plug element, in this case plug 4, may be a cylindrical plug supporting the tube from the inside, particularly so when the die 9 causes and produces external gears 8 only. This particular embodiment actually solves the primary problem posed by prior art shafts with an outer gearing; but it is apparent that the invention offers a large degree of versatility. FIG. 4 shows the resulting gearing.

The second possibility of FIG. 3 arises when this particular blank 1' has also inwardly directed protrusions 10. In this case, the plug 4 of the type shown in FIG. 1 has to be used. It was found that a plug as well as an annular die, having a gear-producing profile, can still serve as a support in those instances in which it is not used directly as a gear-forming tool. Thus, a tool set comprised of a gear-profiled die and a gear-profiled plug can be used for making either kind of gearing or both, as the need arises.

The invention is not limited to the embodiments described above; but all changes and modifications thereof, not constituting departures from the spirit and scope of the invention, are intended to be included.

We claim:

1. Method of providing universal, joint-type or cardan shafts with gearing, comprising the steps of:

providing a tubular blank with local, annular, radially inwardly and/or radially outwardly extending protrusions; and imparting upon the protrusions gear profiles by means of drawing under utilization of a plug and of an annular drawing die, radially aligned with the plug, at least one of the dies and the plug being configured for gear drawing.

2. Method as in claim 1, wherein the annular die as well as the plug have gear-forming profiles, the blank being provided with radially inwardly extending protrusions as well as radially outwardly extending protrusions.

* * * * *